US007789032B1

(12) United States Patent
McDugle et al.

(10) Patent No.: US 7,789,032 B1
(45) Date of Patent: Sep. 7, 2010

(54) BOAT THRUSTER APPARATUS AND METHOD

(75) Inventors: Donald Bruce McDugle, Anacortes, WA (US); Kevin D. Pattison, Oak Harbor, WA (US)

(73) Assignee: Cap Sante Marine, Ltc., Anacortes, WA (US)

( * ) Notice: Subject to any disclaimer, the term of this patent is extended or adjusted under 35 U.S.C. 154(b) by 1329 days.

(21) Appl. No.: 10/726,465

(22) Filed: Dec. 2, 2003

Related U.S. Application Data

(60) Provisional application No. 60/431,285, filed on Dec. 6, 2002.

(51) Int. Cl.
*B63H 25/46* (2006.01)

(52) U.S. Cl. ..... 114/151

(58) Field of Classification Search ..... 114/151; 440/38, 40, 46, 47

See application file for complete search history.

(56) References Cited

U.S. PATENT DOCUMENTS 3,082,732 A * 3/1963 Stallman ..... 440/39
4,208,978 A 6/1980 Eller
4,402,674 A 9/1983 Roberts
4,832,642 A 5/1989 Thompson
5,016,553 A 5/1991 Spencer
5,704,306 A 1/1998 Den Ouden
6,435,120 B2 8/2002 Duncan

OTHER PUBLICATIONS

Various events that occured more then one year prior to the filing date of the above application, presented in the accompanying "Declaration" of Donald Bruce McDugle.

* cited by examiner

*Primary Examiner*—Edwin Swinehart
(74) *Attorney, Agent, or Firm*—Dwayne E. Rogge; Hughes Law Firm, PLLC

(57) ABSTRACT

A thruster mounted to the transom of a boat and aligned to provide a lateral thrust for maneuvering the boat at low speeds. The thruster comprises a central housing having a propeller therein, and two extension members extending oppositely outwardly from end openings of the housing. The extension members each have a lower perimeter portion located below the water line of the boat and arranged to prevent ambient air from being entrained into the water that goes through the central thruster section.

18 Claims, 3 Drawing Sheets

BOAT THRUSTER APPARATUS AND METHOD

RELATED APPLICATIONS

This application claims priority benefit of U.S. Ser. No. 60/431,285, filed Dec. 6, 2002.

BACKGROUND OF THE INVENTION a) Field of the Invention

The present invention relates to thrusters used in boats, and more particularly to stern thrusters which are commonly positioned at the transom of the boat. The present invention is particularly adapted for use in stern thrusters where the draft of the boat (i.e., the depth to which the boat floats in the water) is rather small.

b) Background Art

When a ship is traveling forwardly in the water, the rudder is used to exert a lateral force so as to cause the boat to turn one way or the other. However, when the boat is in "tight" locations with little or no forward travel, maneuvering the boat can be rather difficult.

Accordingly, there are various other means used or proposed for use to improve the maneuverability of the boat in a limited operating area (e.g. in docking and/or other maneuvers), and one of these is to provide thrusters, such as stern thrusters.

The main purpose of the stern thruster is to move the stern of the vessel to port or starboard when there is little or no forward or reverse motion of the vessel. In general, there are three types of stern thrusters which are currently on the market. One of these is the water-jet thruster which discharges jets of water to produce the thrust. These are somewhat expensive and less efficient in comparison with other types of thrusters, and their primary use currently is on fire-boats where there is room for a large engine powering an onboard water pump.

Another type of thruster is the use of a propeller or propellers connected to a hydraulic motor permanently fastened to the vessels' transom. To the best knowledge of the applicants, there is only one such thruster being currently marketed for yachts.

A more common currently used stern thruster is a tunnel-propeller thruster where there is a laterally aligned housing in the form of a cylindrical duct or tunnel positioned at the transom below the water, with one or two propellers positioned in the duct or tunnel.

The tunnel thruster needs to be positioned far enough below the water surface to prevent air being sucked into the tunnel passageway along with the water traveling through the propellers, since this can cause a substantial loss of thrust. Thus, it is generally recommended that the thruster be positioned in the water at least one tunnel diameter below the water line.

However, for smaller boats which have a rather shallow draft, a thruster permanently installed in the transom of the boat has in general been impractical. The dimensions of the thrust apparatus must be sufficiently large to be able to eject water at a volumetric rate sufficient to provide adequate thrust for maneuvering, and yet (as indicated above) be a sufficient distance below the surface of the water so that it will not lose thrust by sucking in ambient air. However, if the lower part of this thrust apparatus is too far down, portions of the thruster will be positioned in the water stream that passes under the hull of the boat, traveling at medium or full speed, thus causing substantial drag.

The result of this is that various stern thrusters have been available for larger boats which have deeper draft, but not for the relatively small boats that have rather shallow draft. One solution is to have a thruster that is vertically adjustable so that it can be lowered into the water when needed and raised upwardly a sufficient level when the boat is running at medium or high speed so as to be out of the water stream. However, for various reasons (quite possibly expense and/or complexity) to the best knowledge of the applicants, that design has not been widely accepted.

A search of the patent literature has disclosed a number of concepts relating to stern thrusters or the like, and these are listed below as follows.

U.S. Pat. No. 6,435,120 B2 (Duncan) shows a lateral thruster for a boat, where there are right and left thrusters each having its own housing with a thrusting propeller and a stator. Surrounding both of these right and left thrusters is a larger duct having open side ends and enclosing the area around the two thrusters, and also enclosing the area between the two thrusters. When one of the thrusters, for example the right thruster, is rotating to provide a thrust, the left thruster would be free-willing and water would flow in the surrounding duct and also through the left thruster toward the right thruster. Also, water from the right side of the surrounding housing would flow inwardly in an area surrounding the right thruster, and also be re-directed to go outwardly through the thruster.

U.S. Pat. No. 5,704,306 (Den Ouden) shows a "stern screw" where there is a lateral thruster in the form of a propeller that is positioned in a surrounding cylindrical housing which provides a "tunnel". It is stated in column 3, line 4, that the tunnel tube lays at least one-half a tunnel tube diameter above the bottom 11 of the boat, and at least one tunnel tube diameter below the waterline. It is indicated that with such a placement of the tunnel tube, well below the waterline, it is found to benefit the propelling force of the stern screw.

U.S. Pat. No. 5,016,553 (Spencer) shows a boat having a thruster which is connected to the steering system of the boat, so that the direction of thrust is controlled from the boat's steering wheel linkage.

U.S. Pat. No. 4,832,642 (Thompson) shows a propulsion installation for a boat, where there are radial vanes which are positioned as a "paddle wheel" where these are positioned partly above the water with the vanes rotating down into the water to provide the thrust. There is shown a water intake at 16 for a hydraulic motor which is protected by a grill 17 to keep debris from coming into the inlet.

U.S. Pat. No. 4,402,674 (Roberts) shows a propulsion system which employs a water jet that ejects the water in a rearward direction. This patent discloses a water intake system which is arranged to prevent air being aspirated into the jet stream. This structure is located at the bottom of the hull and is designated as an "air aspiration prevention pan" which faces downwardly having side walls arranged in a general V-configuration with the apex of the V-configuration toward the forward end of the hull.

U.S. Pat. No. 4,208,978 (Eller) shows a lateral thruster having a cylindrical housing oriented transversely and a propeller thruster mechanism operating to provide the lateral thrust. There is a positioning mechanism which can lower the thruster into the water or pull it upwardly out of the water.

DETAILED DESCRIPTION OF THE EMBODIMENTS

Figure 1:
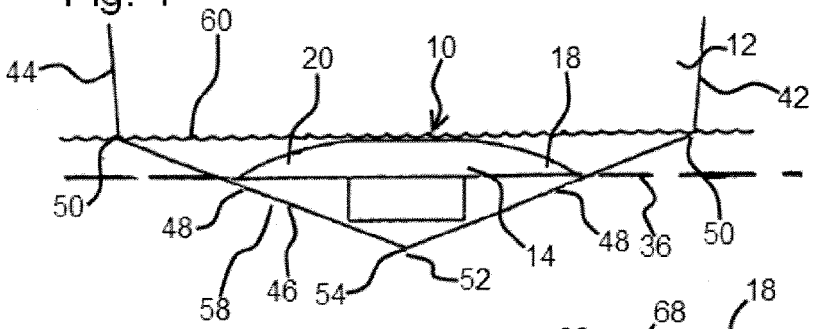
FIG. 1 is a rear elevational view showing a first embodiment of the thruster of the present invention mounted to the transom of a boat.

The thruster apparatus and method of the embodiments of the present invention alleviate various problems encountered with positioning prior art thrusters at the transom of boats, and make it possible to position the thruster at a relatively high position in the water and yet prevent entrainment of air into the water stream that flows through the thruster. This enables the thruster to be used with boats that have a relatively shallow draft, so that the thruster properly performs its functions of providing adequate thrust, but also does not encounter contact with the transom wake surface.

The thruster is adapted to be mounted at an operating location at a transom of the boat, the boat having a bottom, side wall sections, and with rear edge portions adjacent to the transom, and also a water line at the transom.

In these embodiments, the thruster comprises a central thrusting section which has a central lengthwise axis and comprises a center housing defining a through passageway that is generally aligned the lengthwise axis. The center housing has two oppositely positioned outer end portions, each of which defines an opening leading into the passageway. A propeller section is positioned in the through passageway.

There are two extension members that are positioned at opposite sides of the central housing, with each extension having an inner end portion adjacent to a related one of the outer end portions of the housing and extending outwardly therefrom. Each extension member has a lower perimeter edge portion which is located so that with the thruster in its operating position, the perimeter edges are below the water line of the boat.

Each extension has a lower downwardly facing generally concave surface that defines a partial flow chamber and is contoured to provide a partial flow passageway which leads upwardly and inwardly within the concave surface to an adjacent one of the outer end openings of the central housing.

The thruster is configured and arranged so that with the thruster located at the transom in its operating position, when the boat is traveling at sufficiently high speed through the water to cause the water to separate from the transom and form a transom wake surface, lower and outer end portions of the thruster are substantially clear of water that is at the transom wake surface. Also, the thruster is configured and arranged so that when the thruster is operating and the boat is stationary in the water or traveling at a sufficiently low speed so that the water does not separate from the transom to form a transom wake, the two extension members have their lower edge portions at a sufficient depth and also located so that as water flows by the lower perimeter edge portions and into one of the end openings of the center housing, ambient air is substantially prevented from being entrained in the water and entering into the passageway of the center housing.

In the method of the present invention, the thruster is provided as recited above, and is also positioned in its operating position adjacent to the transom. When the boat is stationary in the water or traveling at a sufficiently low speed so that water does not separate from the transom to form the transom wake, the thruster can then be operated by operating the propeller section to cause water to flow through the passageway of the central housing, thus providing a thrust. The inlet into which the water is flowing draws water from beneath the water surface in a manner that as water passes from locations proximate to the lower perimeter edge portions of the extension members and around the perimeter edge portions of the extension members, ambient air is prevented from entering into the passageway of the central housing.

In the following description, the main components of a first embodiment of the present invention will first be described, and then the manner in which the thruster of this embodiment is positioned at the transom of a boat. This will be followed by a more detailed description of various features of the present invention and also further embodiments.

Figure 2:
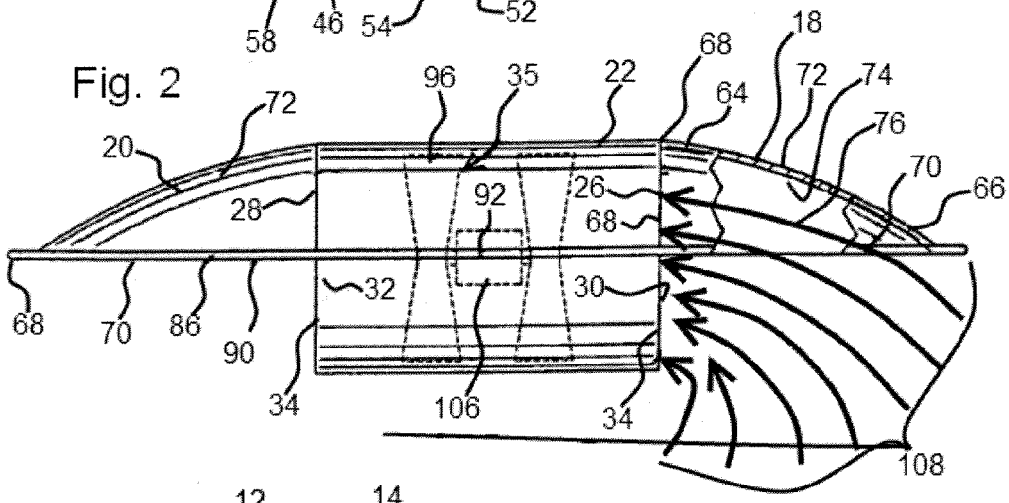
FIG. 2 is a rear elevational view, similar to FIG. 1, of the thruster of this first embodiment shown by itself.

Reference is first made to FIGS. 1 and 2. In FIG. 1, there is shown the thruster 10 of the present invention mounted at the stern of a boat 12, and more particularly mounted to the transom 14 of the boat (i.e., the back wall of a boat).

The thruster 10 comprises a central thrusting section 16 and two extension members 18 and 20 connected to the central section 16 and located on the port and starboard sides of the central section 16, respectively. The central thrust section 16 comprises a housing 22 which defines a central through passageway or chamber 24, and has opposite end portions 26 and 28, respectively, with each end portion 26 and 28 having a through opening 30 and 32, and with each opening 30 and 32 being defined by a surrounding rim 34 of the housing end portions 26 and 28 which may be integral with the central housing. A propeller section 35 is mounted in the passageway 24.

To facilitate the description of the present invention, the thruster 10 shall be considered as having a central lengthwise axis 36 which, with the thruster 10 mounted to the transom 14, extends horizontally and parallel with the back surface of the transom 16, and perpendicular to a forward to rear longitudinal center axis of the boat 12. There is a transverse axis 38 (see FIG. 3) which extends horizontally and parallel to the longitudinal axis of the boat 12, and also a vertical axis 40.

Reference is now made to FIG. 2 which illustrates the thruster 10 mounted to the boat 12. The boat 12 comprises a hull 42 having side walls 44 and a bottom wall 46, with this bottom wall 46 comprising two bottom sections 48, each bottom section 48 having an outer edge 50 and an inner edge 52 at a boat center line 54. As shown herein, each bottom wall section 48 has a lower surface portion 56 which has a rear edge portion 58, which in this particular configuration is a straight line edge surface portion 58. It is to be understood that the boat 12 itself is or may be of conventional design, and that different hull configurations could be used in the present invention. Also, the boat 12 has a water-line indicated at 60. This water-line 60 is defined as the level at which the upper surface of the water meets the hull of the boat when the boat is freely floating in the water with the total effective weight of the boat being the weight of the boat itself, including the various attachments and equipment of the boat, and also with the normal minimum expected "passenger load." This "passenger load" would be the minimum number of person or persons of average weight that would be on the boat, plus possibly other articles that might be brought on-board by the passenger or passengers. The significance of this shall be discussed later in this text. Also, the term "edge" or "edge portion" is not intended to be limited to mean a sharp corner, but could be a rounded intersecting location.

The two extension members 18 and 20 are substantially identical, so the following description will be given with respect to the extension member 18, with the understanding that this also applies to the extension member 20. In describing the extension members 18 and 20 relative to the central thrusting section 16, the term "outer" shall refer to a lateral direction along the central axis 36 of the thruster 10 that is away from the forward to rear center line of the boat 12, and toward either the port or starboard side, and the proximity to those locations further from the longitudinal center line of the boat 12. The term "inner" shall refer to a direction toward or a location closer to the longitudinal center line of the boat 12, along the center axis 36 of the thruster 10.

Each extension member 18 comprises an extension wall 62 comprising an inner end portion 64, an outer end portion 66, a connecting inner edge 68, and a lower perimeter edge portion 70.

Figure 4:
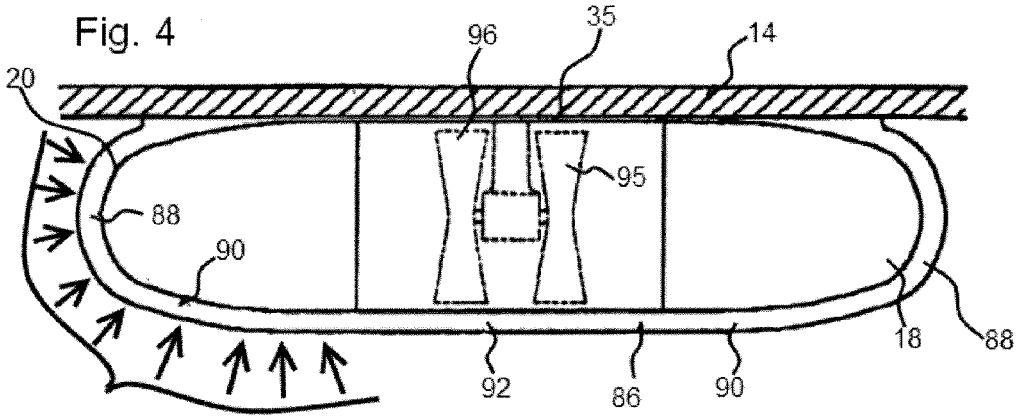
FIG. 4 is a top plan view of the thruster of FIGS. 2 and 3 mounted to the transom.

The extension wall 62 has an overall curved configuration, with the curve at the inner end portion 64, relative to a transverse section perpendicular to the lengthwise axis 36, being semi-circular in a full 180° curve. The curved contour of the wall 62 in a direction toward the outer end portion curves downwardly in a moderately concave contour, and has a smaller degree of curvature relative to the contour taken transversely across the wall 62, as we move outwardly toward the outer end portion 66. The lower perimeter edge portion 70 has in plan view a generally oval configuration with its lengthwise dimension being moderately greater than its width dimension (see FIG. 4). The term "overall configuration" is to be interpreted in a broader sense, and there could be various portions of a flat planar configuration, flat portions jointed together at angles other than one-hundred eighty degrees) (180°, etc. The same is true of the term "oval configuration," and also in other portions of the following text.

The extension wall 62 can be considered as having an outside generally convex wall surface 72 that faces generally upwardly, and a lower inside surface 74 which follows the overall contour of the extension wall 62.

This lower inside surface 74 defines what can be called a "partial flow chamber 76" or a "partial passageway 76" which leads upwardly and inwardly in an inwardly generally curved concave configuration, with the passageway 76 having a greater depth dimension at an inner end thereof than at an outer end thereof, so that when the partial flow passageway 76 reaches the passageway 24 of the central housing 22, the adjacent inner surface portion 74 forms a substantially continuous generally smooth surface contour with the inner surface 78 (see FIG. 3) of the passageway 24. The curved contour of the inner surface 74 thus forms with the inner surface 78 forming with the passageway 24 a substantially continuous and hydro-dynamic contoured flow surface to optimize the flow of water along the inner surface 74 and into the inner surface 78 without creating any significant turbulence in the flow stream.

Figure 3:
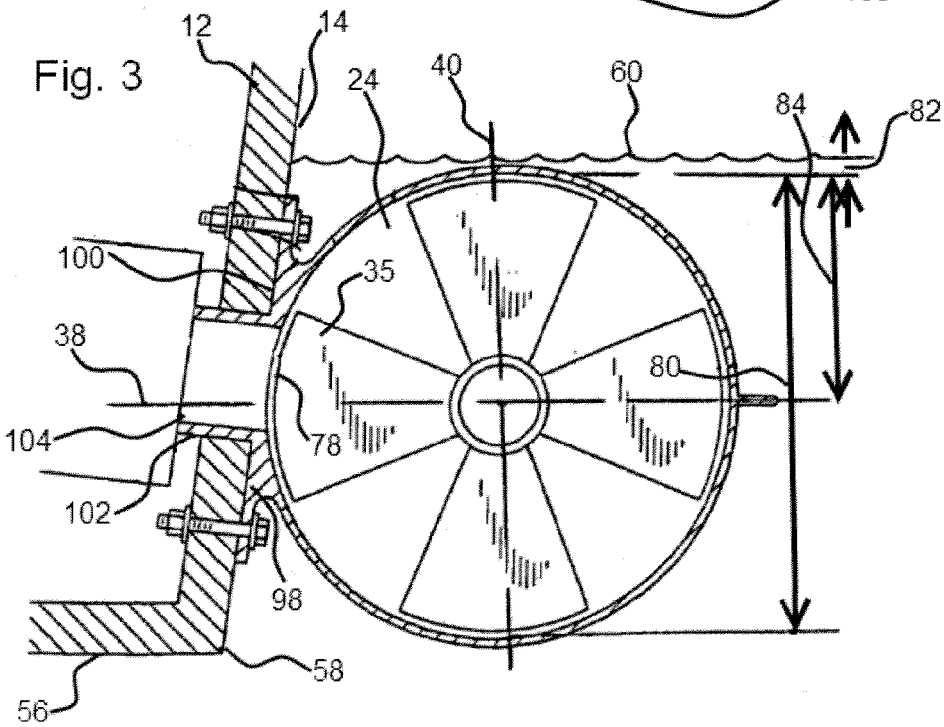
FIG. 3 is a side elevational view of the thruster of FIG. 2 partly in section, mounted to the transom of the boat.

To describe this embodiment further, let us now refer to FIG. 3 to lay a framework for some dimensional relationships. There is first a passageway depth dimension indicated at 80 which is equal to the inside diameter of the inner surface 78 of the passageway 24. Then, there is a passageway/waterline depth dimension indicated at 82, which is the vertical distance between the waterline 60 and the upper inside surface portion of the inner surface 78. It can be seen in FIG. 3 that this dimension 82 in this embodiment is minimal, substantially non-existent, or even negative (i.e. where the upper inside surface portion of the inner surface 78 is above the waterline). Then, there is the mid-height upper depth dimension 84 which is the distance between the center line of the passageway 24 to the upper surface portion of the passageway inner surface 78. In this present preferred embodiment, the lower perimeter edges 70 of the two extensions 18 and 20 lie generally in a horizontal plane at the lower end of this mid-height upper depth dimension 84 (i.e. at the center-line of the passageway 24 and in two openings 30 and 32).

In addition to the dimension-related items noted above and in addition to the location of the waterline 60, there is an additional relationship, and this concerns the flow of the water rearwardly from the lower edge portions 58 of the transom 14 when the boat is traveling at a speed which would be in excess of, for example, about four to five knots, this being the speed where the water separates from the transom so that as the boat travels through the water, and the surface of the water passing by the lower rear edge portions 58 of the lower surface portions 56 travels in a moderately upward and rearward slant, with the flow of this water converging toward a center location.

In this description, this water surface will be called a "transom wake surface." This transom wake surface will become flatter (have less slant relative to the horizontal) as the boat is moving at a higher velocity. If portions of the thruster 10 extend into the transom wake surface, this can cause unwanted additional drag. Also, if a portion of the thruster 10 is extending into this transom wake surface, such as the outer edges of the extension members 18 and 20, this can cause something of a "rooster tail" in the water which in addition to the drag is objectionable because of the "aesthetics" of the boat cruising in hopefully a streamline manner through the water.

The thruster 10 also has a perimeter flange 86 which is part of the lower perimeter edge portion 70 and is horizontally aligned and located at the mid-height of the passageway 24, so that it has outer end flange portions 88 at the two outer end portions of the extension members 18 and 20, rear outer flange portions 90 at the rearwardly positioned perimeter edges 70 of the extension members, and also a central flange portion 92 extending along the rear mid-height of the central housing 22. In this particular embodiment, the width of the perimeter flange 86, indicated at 94, is about one inch, but obviously this dimension could be increased or decreased substantially. Thus, the overall width of the extension members 18 and 20 may be at least as great or greater than the width of the end openings 30 and 32 of the housing 22.

The propeller section 35 is, or may be, conventional. As shown herein, the propeller section comprises two propellers 96, each mounted for rotation about the center lengthwise axis 36. The propellers 96 are either solidly connected to one shaft, or can be counter rotating.

The manner in which the thruster 10 is mounted is or may be conventional. As shown in FIG. 3, the thruster 10 has a rear mounting bracket 98 which has a forwardly facing flat mounting surface 100, and also a cylindrically shaped forwardly extending positioning member 102, with this forward extension member 102 also providing an open area 104 through which the drive shaft can be positioned to rotate the propellers 96. A suitable drive transmission component is shown schematically at 106 to be positioned between and adjacent to the two propellers 96. Since the entire drive transmission is or may be conventional, this will not be described further herein.

To describe now the operation of the present invention, we will assume that the boat is in what we shall term "lateral thrust operating mode" where the boat is either stationary in the water or moving at a sufficiently low speed so that the water does not separate from the rear surface of the transom, and there is not formed the previously described "transom wake surface." Also, we will assume that the thruster 10 is located in its operating position mounted to the rear of the transom 14, as described above. With the housing 22 having a tubular cylindrical configuration, and with the wall of the housing 22 having a thickness only necessary to provide adequate structural strength, the upper outer surface of the central housing 22 is at, or closely adjacent to, the water level 60, and the upper portion of the inner surface 78 of the passageway 24 is also at or closely adjacent to the water level 60.

Let us now assume that the thruster 10 is to be operated to move the stern of the boat either to starboard or to port. Both of the propellers 96 are operated under power to cause them to rotate and provide a thrust, and the propellers 96 rotate together in either direction of rotation. In this particular instance, let us assume that the thrust is such that the water will enter the opening 30 at the right end portion 26 of the central thrusting section 16, and that the water is exiting at the left opening 32 of the central thrusting section 16. As indicated earlier in this text under the section, "Background Information," it was pointed out that in conventional thrusters, with the thruster being positioned closely adjacent to the waterline, air is entrained into the passageway of the thruster through which the water flows, thus causing a loss of thrust.

However, in the configuration with the present invention, this does not occur. Rather, the flow of the water into the end opening 30 is taken from surrounding water which is sufficiently below the water surface and also sufficiently spaced from the end opening 30, so that atmospheric air from the air immediately above the waterline 60 is not entrained in the water flow which travels into the opening 28. Further, it has been found that the flow of the water is such that this flow is substantially non-turbulent, so that the cross-section of any segment of water passing through the passageway 24 in the area of the propellers 96 is sufficiently uniform across its transverse cross-section, that the propeller is able to operate in the water stream to provide maximum or near maximum thrust that is potentially available.

While there are quite likely various subtleties and complexities in the hydro-dynamic flow patterns that are possibly not fully understood, it is surmised that the following analysis is able to explain at least partially some of the various hydro-dynamic phenomena involved. However, regardless of whether or not this following explanation is correct or incorrect, and also regardless of whether or not it has inaccuracies, it has been found that the present invention does accomplish the goals and basic results as indicated above.

To proceed with this explanation, as soon as one of the propellers 96 begins operating, these create a pressure drop at the location of the end opening 30, and this causes the surrounding water to move toward the opening 30. In FIG. 2, there are drawn several arrows 108 to demonstrate generally this flow pattern. Also, in FIG. 4, there are arrows 109 indicating this flow pattern as seen from a top plan view, but with the propellers 96 turning in the opposite direction so that the flow is in the opposite direction.

Now, let us consider the water which is closer to the upper surface of the body of water. The two extension members 18 and 20 provide a shield or barrier for the water that is immediately above the areas adjacent to the two inlet openings 30 and 32. Also, it needs to be recognized that the water pressure increases as the depth increases. With the atmospheric pressure at sea level being approximately 14.7 pounds per square inch, the water pressure at a little greater than one-half foot down is about 0.025 pounds per square inch greater. Therefore, there is more pressure acting on the water at a lower depth to move it to the reduced pressure area of the inlet 30 or 32. For the atmospheric air above the water level to be drawn into the water so as to pass into either of the inlets 30 and 32, there must be sufficient pressure to move the surface water downwardly toward the mid-height of the openings 30 and 32. Experimental results have been demonstrated by observing the flow patterns of the water at the surface while the thruster is positioned as shown in FIG. 1 and operating at full thrust, that there is no perceptible inflow from the water adjacent to the upper water surface downwardly and into either of the inlets 30 and 32 that is drawing in water at that time.

Further, if there is any such inflow, it is sufficiently small so that there is no significant loss of thrust. It has been observed that when the configuration of the present invention is utilized and the thruster is at the location as shown in FIG. 1, there is no perceptible loss of thrust in comparison with the thruster being operated without the extension members 18 and 20 and at a lower level where its upper surface portion is at a distance of one diameter of the inlet opening below the surface.

As indicated earlier, another factor is the positioning of the thruster 10 relative to the transom wake surface that originates at the lower transom edge portions 58. In the configuration of this first embodiment, there are at least four locations of the thruster 10 that are of concern. First, there are the two outer end locations 88 of the perimeter flange 86. Second, there are the two outer lower edge portions of the rim 34 of the housing 22. These locations should not be positioned so that they would be in the path of the transom wake surface. Thus, there can be considered something of an "envelope" in which the thruster 12 must fit. This envelope is defined at the lower side by the two slanting portions of the transom wake surface, determined by the location of the transom lower edge portions 58, and in the upper part by the water level 10. The water level 10 is not necessarily the absolute upper limit to the envelope, since there is some variability in how far up the thruster can be positioned relative to the water surface 60.

Figure 6:
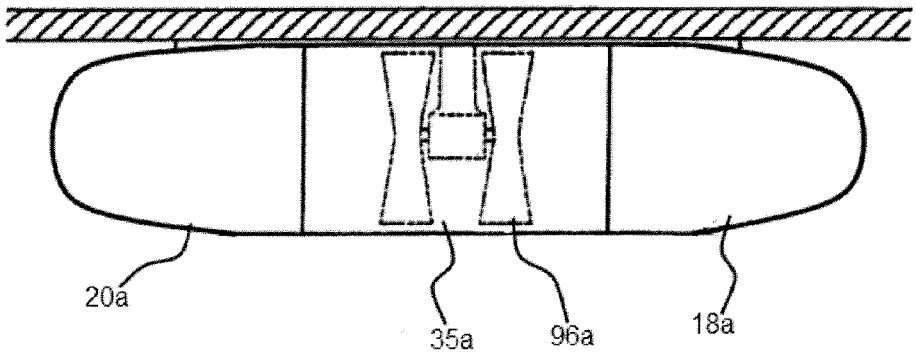
FIG. 6 is a top plan view, similar to FIG. 4, showing the second embodiment.
Figure 7:
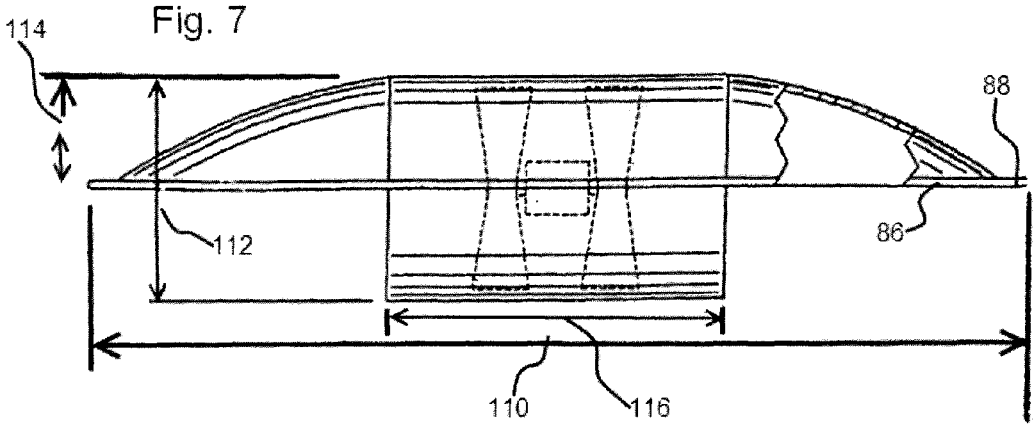
FIGS. 7 and 8 are the same as FIGS. 1 and 2, and are provided to show various dimensions and dimensional relationships of these embodiments.
Figure 8:
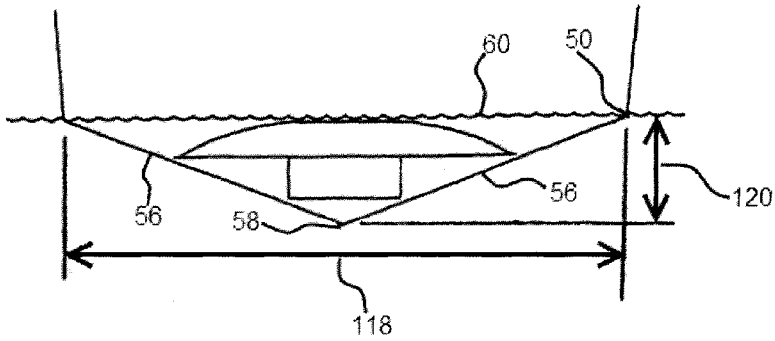

In FIGS. 7 and 8, there are given the dimensions of one exemplary embodiment which has been found to be suitable. The overall length dimension 110 between the outside end edges 88 of the flange 86 is 34 inches. The vertical dimension (i.e., the diameter) of the inside surface of the passageway 34 is indicated at 112, and this is 7.3 inches. The distance 114 from the lower edge of the outer flange portion 88 (or of the lower edge of the extension 18*a* and 20*a* of FIG. 6), up to the level of the upper part of the inner surface 78 of the passageway 24, is 3.65 inches. The length 116 between the two inlet openings 30 and 32 is 12 inches, so that each of the extension members 18 and 20 has a length of eleven inches. Thus, the ratio of the depth of the end openings 30 and 32 to the length of the extension members may be at least one to one or at least as great as one to one-half.

This thruster 10 has been found to be suitable for a smaller boat having a distance between the outer edges 50 of the two bottom portions 58 of 84 inches, this distance being indicated at 118 in FIG. 8. The vertical distance from the level of the outer edge 50 to the level of the bottom mid-location at 58 is indicated at 120 and is about 9 inches.

As the boat becomes larger or smaller, and as the vertical distance between the waterline 60 and the bottom surfaces 56 becomes greater or less, these dimensions of the thruster can also be modified.

In this embodiment shown in FIGS. 1-4, the dimension 110 between the outside edges 88 (or between the outside edges of the extensions 18 and 20 of FIG. 7), of flange 86 is forty percent of the distance between the outer edge portions 50 of the hull. The length 116 between the two inlet openings 30 and 32 is about fifteen percent (i.e., 3/20) of the distance 110 between the outer edges 50 of the rear portions of the two bottom portions 58 of the hull. The vertical dimension 112 of the inside surface of the passageway 34 is about 82 percent of the vertical distance 120 from the level of the outer edge 50 of the rear portions of the hull bottom portions 58 to the level of the bottom mid location at 58.

The lengthwise dimension 116 between the two inlet openings 30 and 32 is about thirty-six percent of the distance 118 between the outside end edges 82 of the flange 86 (or between the outside edges of the extension members 18 and 20).

The vertical dimension 114 from the lower edge of the outer flange portion 88 (or the lower edges of the extension members 18*a* and 20*a*) up to the level of the upper part of the inner surface 78 of the passageway 24 is about fifty percent of the vertical dimension 112 of the inside surface of the passageway.

These ratios can vary, depending upon the configuration of the hull and the thruster.

This forty percent value could be between forty-two to thirty-eight percent, or could vary between thirty percent to forty-five percent, and within a broader range in five percent increments down possibly as low as thirty to twenty percent, and upwardly in five percent increments as high as possibly sixty to seventy percent.

The fifteen percent of value would depend on large part on the basic construction of the thruster, and could be as low as possibly thirteen percent, eleven percent, nine percent, and seven percent or lower, and could increase also in two percent increments to twenty-five percent, and from five percent increments as high as forty percent or higher.

The eighty-one percentage value could increase possibly in one percent increments up to ninety percent, or possibly decrease to a value as low as about ¾ or ⅔, depending on other relative dimensions. The thirty-six percent value could be up to thirty-eight or forty percent, or in some situations, be higher in five percent increments up to fifty percent or sixty percent; or downwardly in two percent increments to thirty percent, and also possibly as low as twenty percent in two percent increments.

The fifty percent value conceivably decrease or increase in five percent increments up to seventy-five percent or downwardly in five percent increments to as low as twenty-five percent.

Figure 5:
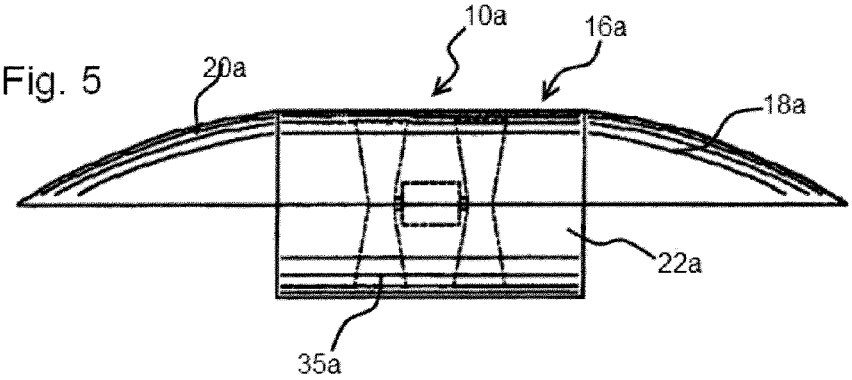
FIG. 5 is a rear elevational view, similar to FIG. 2, showing a second embodiment of the present invention.

A second embodiment of the present invention is illustrated in FIGS. 5 and 6. This second embodiment is substantially similar to the first embodiment, so for those components of the second embodiment which are the same as, or substantially similar to, the corresponding components of the first embodiment, there will be given the same numerical designations with an "a" suffix distinguishing those of the second embodiment. The main difference in the second embodiment is that the perimeter flange 86 of the lower perimeter edge portion 70 has been eliminated. In this instance, it would be possible to extend the dimensions of the walls of the two extension members 18 and 20 outwardly from the center of the thruster 10 and still be within the limits of the required envelope.

Since the limiting dimension in the distance between the outer edges of the extension member 18*a* and 200 is providing sufficient clearance from the transom wake surface, the limits of this dimension (which for the first embodiment is indicated at 110) would be the same as the distance between the outer edges of the two extensions 18*a* and 18*b*.

In other respects, the components of the second embodiment are substantially the same as the corresponding components of the first embodiment, so that there is the central thruster section 16*a*, the propeller section 35*a* mounted to the passageway 24*a*, etc.

It is to be recognized that various modifications and/or additions can be made to the present invention without departing from the basic teachings thereof, for example, many of the contours could be modified. For example, the contour of the lower perimeter edges 70 of the extension members 18 and 20 could have the contours modified and not necessarily be limited to the edges lying in a single horizontal plane. Further, instead of making the central housing 22 a precise cylindrical configuration, it is possible that these contours could be modified, possibly to create desired effects of the flow pattern of the water entering into the propeller section 35.

Further, while the present invention has been shown in the environment of a boat having a hull with the two downwardly and inwardly extending bottom wall sections 48 being in a shallow V-pattern, it is evident that the present invention could be used in connection with hulls of other shapes. If so, then the envelope within which the thruster would be placed would likewise be modified, and then the relative dimensions may have to be modified to obtain the optimized results and also be within that envelope.

These above modifications are given by way of example and are not intended to exclude the possibility of yet other modifications and/or additions.

Therefore I claim:

1. A thruster boat combination comprising:

a) a boat comprising a hull having a water line, side walls, a bottom wall, and a transom, with said bottom wall comprising two wall sections which extend from side locations in a downward and laterally inward slant to a central juncture location of the two bottom wall sections, and with said transom meeting said bottom and side walls at bottom and side edge locations thereof, said boat having a thrust operating mode where the boat is stationary or is moving at a sufficiently low speed so that water remains adjacent to the transom;

b) a thruster which is mounted at the transom of the boat so as to provide lateral thrust, said thruster comprising:

i) a central thrusting section which has a lengthwise axis and comprises a central housing that defines a through passageway that is generally aligned with said lengthwise axis and has two oppositely positioned outer end portions, each of which defines an end opening;

ii) a propeller section positioned in said through passageway;

c) two extension members that are positioned at opposite sides of the central housing, with each extension member having an inner end portion adjacent to a related one of said outer end portions of the central housing and extending outwardly therefrom, each extension member having a lower perimeter edge portion which is located so that with the thruster in an operating position and with the boat being in a lateral thrust operating mode, the perimeter edge portions of the two extension members are below the water line of the boat, each extension member having a lower downwardly facing surface that defines a flow passageway at the downwardly facing surface, said flow passageway having an inner end flow passageway portion adjacent one of the end openings of the central housing;

d) said thruster being configured and arranged, so that with the thruster located at the transom in its operating position:

i) when the boat is traveling at a sufficient speed through the water to cause the water to separate from the transom and form a transom wake surface, the thruster is substantially clear of the water that is at the transom wake surface, ii) when the thruster is operating and the boat is in a lateral thrust operating mode, the two extension members have their lower perimeter edge portions located so that as water flows by the lower perimeter edge portions and into one of the end openings of the center housing, ambient air is substantially prevented from being entrained in the water entering into the center housing, and wherein a distance between outer end edges of the two extension members is no greater than about sixty percent and no less than about twenty five percent of a distance between outer edge locations of the transom where the bottom and side walls meet.

2. The combination as recited in claim 1, wherein a distance between outer end edges of the two extension members is no greater than about fifty percent and no less than about thirty percent of a distance between outer edge locations of the transom where the bottom and side walls meet.

3. The combination as recited in claim 1, wherein a distance between outer end edges of the two extensions is no greater than about forty percent of a distance between outer edge locations of the transom where the bottom and side walls meet.

4. The combination as recited in claim 1, wherein a distance between outer end edges of the two extension members is no less than about thirty percent of a distance between outer edge locations of the transom where the bottom and side walls meet.

5. The combination as recited in claim 1, wherein each end opening of the housing is defined by a surrounding rim having a depth dimension, each of said extension members having a maximum width dimension extending from one side of said extension member to the other side thereof, said maximum width dimension being at least about equal to or greater than the depth dimension of the end opening of the housing adjacent to that extension member.

6. The combination as recited in claim 5, wherein each of said extension members has its downwardly facing surface shaped so that the flow passageway has a greater depth dimension at said inner end flow passageway portion and a lesser depth dimension at an outer end portion of said extension member.

7. The combination as recited in claim 1, wherein a substantial portion of the perimeter edge portion of each extension member is below an upper portion of a surrounding rim defining the end opening of the central housing by a distance that is at least about one-half of a depth dimension of the end opening defined by the surrounding rim.

8. The combination as recited in claim 1, wherein each end opening of the housing is defined by a surrounding rim defining the end opening, each of said end openings have a depth dimension, each extension member having an inner end portion adjacent to its related end opening, an outer end portion, and a length dimension from said inner end portion to the outer end portion, with a length dimension from said inner end portion to said outer end portion of the extension member being at least as great as the depth dimension of its related end opening.

9. The combination as recited in claim 8 wherein said length dimension from said inner end portion to said outer end portion of the extension member is at least as great as one and one-half times said depth dimension.

10. The combination as recited in claim 4, wherein a length dimension of the central housing section of the thruster is between about nine percent to thirty percent of a length dimension between outer edge locations of the transom where the side walls meet the bottom wall.

11. The combination as recited in claim 4, wherein a length dimension of the central housing section of the thruster is no greater than about thirteen percent to about twenty percent of a length dimension between outer edge locations of the transom where the side walls meet the bottom wall.

12. The combination as recited in claim 4, wherein a length dimension of the central housing section of the thruster is about nine percent to three-twentieths of a length dimension between outer edge locations of the transom where the side walls meet the bottom wall.

13. The combination as recited in claim 1, wherein an upper portion of said center housing of the thruster is at a depth below the water line of the boat which is less than a distance equal to a vertical dimension of the end opening of the passageway of the central housing.

14. The combination as recited in claim 13, wherein the upper portion of the center housing of the thruster is at or adjacent to the water line of the boat.

15. The combination as recited in claim 1, wherein a vertical dimension of one of the end openings of the passageway of the central housing is no less than about two-thirds of a vertical distance between the water line and a lower portion of the transom of the boat.

16. The combination as recited in claim 1, wherein a vertical dimension of one of the openings of the passageway of the central housing is no less than about three-quarter of a vertical distance between the water line and a lower portion of the transom of the boat.

17. The combination as recited in claim 1, wherein a vertical dimension of one of the openings of the passageway of the central housing is no less than about eighty-one percent of a vertical distance between the water line and a lower portion of the transom of the boat.

18. A thruster boat combination comprising:

a) a boat comprising a hull having a water line, side walls, a bottom wall, and a transom, with said bottom wall comprising two wall sections which extend from side locations in a downward and laterally inward slant to a central juncture location of the two bottom wall sections, and with said transom meeting said bottom and side walls at bottom and side edge locations thereof, said boat having a thrust operating mode where the boat is stationary or is moving at a sufficiently low speed so that water remains adjacent to the transom;

b) a thruster which is mounted at the transom of the boat so as to provide lateral thrust, said thruster comprising:

i) a central thrusting section which has a lengthwise axis and comprises a central housing that defines a through passageway that is generally aligned with said lengthwise axis and has two oppositely positioned outer end portions, each of which defines an end opening;

ii) a propeller section positioned in said through passageway;

c) two extension members that are positioned at opposite sides of the central housing, with each extension member having an inner end portion adjacent to a related one of said outer end portions of the central housing and extending outwardly therefrom, each extension member having a lower perimeter edge portion which is located so that with the thruster in an operating position and with the boat being in a lateral thrust operating mode, the perimeter edge portions of the two extension members are below the water line of the boat, each extension member having a lower downwardly facing surface that defines a flow passageway at the downwardly facing surface, said flow passageway having an inner end flow passageway portion adjacent one of the end openings of the central housing;

d) said thruster being configured and arranged, so that with the thruster located at the transom in its operating position:

i) when the boat is traveling at a sufficient speed through the water to cause the water to separate from the transom and form a transom wake surface, the thruster is substantially clear of the water that is at the transom wake surface, ii) when the thruster is operating and the boat is in a lateral thrust operating mode, the two extension members have their lower perimeter edge portions located so that as water flows by the lower perimeter edge portions and into one of the end openings of the center housing, ambient air is substantially prevented from being entrained in the water entering into the center housing, and a) wherein a distance between outer end edges of the two extension members is no greater than about sixty percent and no less than about twenty five percent of a distance between outer edge locations of the transom where the bottom and side walls meet, b) wherein a distance between outer end edges of the two extension members is no less than about thirty percent of a distance between outer edge locations of the transom where the bottom and side walls meet, and c) wherein a distance between outer end edges of the two extensions is no less than about forty percent of a distance between edge locations of the transom where the bottom and side walls meet.

* * * * *